US009717933B2

(12) United States Patent
Huehn et al.

(10) Patent No.: US 9,717,933 B2
(45) Date of Patent: Aug. 1, 2017

(54) RESCUE ELEVATOR SYSTEM

(71) Applicant: IVECO MAGIRUS AG, Ulm (DE)

(72) Inventors: Alexander Huehn, Ulm (DE); Heiner Hoersch, Langenau (DE)

(73) Assignee: IVECO MAGIRUS AG, Ulm (DE)

( * ) Notice: Subject to any disclaimer, the term of this patent is extended or adjusted under 35 U.S.C. 154(b) by 0 days.

(21) Appl. No.: 15/157,630

(22) Filed: May 18, 2016

(65) Prior Publication Data

US 2016/0339275 A1 Nov. 24, 2016

(30) Foreign Application Priority Data

May 19, 2015 (EP) ..... 15168271

(51) Int. Cl.
*B66F 11/04* (2006.01)
*A62B 1/02* (2006.01)
(Continued)

(52) U.S. Cl.
CPC ..... *A62B 1/02* (2013.01); *B66F 11/046* (2013.01); *E06C 5/04* (2013.01); *E06C 7/12* (2013.01)

(58) Field of Classification Search
CPC ..... E06C 7/16; E06C 7/12; E06C 5/04; E06C 1/39; E06C 1/397; E06C 5/16;
(Continued)

(56) References Cited

U.S. PATENT DOCUMENTS 2,109,196 A * 2/1938 Honig ..... E06C 7/12 182/103
2,961,060 A * 11/1960 Taylor ..... E06C 1/397 182/102
(Continued)

FOREIGN PATENT DOCUMENTS

| | | |
|---|---|---|
| CN | 102979449 | 3/2013 |
| JP | 2003290375 | 10/2003 |
| JP | 2007068555 | 3/2007 |

OTHER PUBLICATIONS

European Search Report for European Application No. EP15168271; Nov. 3, 2015; 4 pages.

*Primary Examiner* — Daniel Cahn
(74) *Attorney, Agent, or Firm* — Stetina Brunda Garred and Brucker

(57) ABSTRACT

Rescue elevator system, comprising a rescue ladder and an elevator running on rails on a top side of the rescue ladder up to an end position at one end of the rescue ladder, and an elevator drive comprising a rope, a rope winch for pulling the rope and a deflection roller over which the rope is guided from the rope winch to a suspension point at the elevator, wherein the deflection roller is disposed below the rails at or near the one end of the rescue ladder, characterized in that the suspension point is displaced towards a trailing end of the elevator averted from the one end of the rescue ladder such that in the end position of the elevator, the suspension point is located in a distance from the deflection roller in the extension direction of the rails, and the elevator comprises a passage ladder to bridge the distance between the suspension point and the deflection roller in the end position of the elevator, said passage ladder lying on top of the rope and being mounted between the rails at a hinge axis perpendicular to the extension direction of the rails and extending generally towards the one end of the rescue ladder such as to be pivotable between a flat position in which it lies generally parallel to the plane of the rails and an inclined position in which it is inclined downwardly towards the bottom side of the rescue ladder.

5 Claims, 3 Drawing Sheets

(51) Int. Cl.
*E06C 5/04* (2006.01)
*E06C 7/12* (2006.01)

(58) Field of Classification Search
CPC .. A62C 27/00; A62C 1/02; B66F 9/06; A62B 1/04; A62B 5/00; A62B 1/02
See application file for complete search history.

(56) References Cited

U.S. PATENT DOCUMENTS 6,533,070 B1 * 3/2003 Elrod ..... E06C 1/345
182/103
2013/0287531 A1 * 10/2013 Connors ..... B66B 9/193
414/598

* cited by examiner

RESCUE ELEVATOR SYSTEM

CROSS-REFERENCE TO RELATED APPLICATIONS

The present application claims priority to European Patent Application No. 15168271.3 filed May 19, 2015, the entirety of the disclosure of which is expressly incorporated herein by reference.

STATEMENT RE: FEDERALLY SPONSORED RESEARCH/DEVELOPMENT

Not Applicable

BACKGROUND

The present invention relates to a rescue elevator system, comprising a rescue ladder and an elevator running on rails on a top side of the rescue ladder, according to the features of the preamble of claim 1.

Rescue ladders, like telescopic turnable ladders mounted on firefighting vehicles, are often equipped with rescue elevators that can run along the extension length of the ladder up to their movable free end. Persons to be rescued can enter the elevator at its end position at the free end of the ladder to be transported safely down to the ground. The elevator generally comprises a chassis with rollers running on the rails of the rescue ladder, and a cage mounted on the chassis for accommodating passengers. For driving the elevator, a rope is provided that is pulled by means of a rope winch provided at the mounting of the ladder. The rope is guided from the rope winch over at least one deflection roller towards a suspension point at the elevator. The deflection roller is disposed below the rails at or near the free end of the rescue ladder. By this deflection roller, the pulling force of the rope winch is deflected like in a classical pulley tackle such that it acts on the elevator to pull it towards its top end position. The end of the elevator approaching the free end of the ladder during this movement shall be designated in the following as its leading end, while the end of the elevator averted from the free end of the ladder shall be referred to as the trailing end.

When the elevator approaches its top end position, the transmission of the pulling force to the suspension point becomes increasingly disadvantageous. This is because in the common suspension systems, the rope sections running to and from the deflection roller include an angle of increasing size, with the consequence that with increasing pulling height there is an increasingly growing force component acting on the suspension point towards the bottom side of the ladder opposite to the rails. At the same time, the remaining force component acting to pull the elevator towards its end position is rapidly decreasing. With common elevators whose suspension point is located near their leading end in the pulling movement, it is practically impossible to reach the end of the rescue ladder where the deflection roller is located, because the force components acting perpendicular to the rails tend to deform the framework of the ladder and to pull the rescue elevator onto the rails, instead of supporting its sliding movement. Moreover, there is another disadvantageous effect by this unfavourable load transmission, because forces are generated to raise the elevator from the rails so that its running characteristics are impaired.

On the other hand, it is desired to move the elevator as far as possible towards the free end of the rescue ladder, where a rescue cage is usually mounted, to facilitate a safe passage of persons from the rescue cage into the elevator, in particular inexperienced persons with injuries, physical or mental restrictions, etc.

BRIEF SUMMARY

It is therefore an object of the present invention to provide a rescue elevator system of the above kind with an improved force transmission of the elevator drive from the rope winch to the suspension point at the elevator, avoiding disadvantageous forces on the rescue ladder and on the elevator, and enabling a smooth course towards the free end of the ladder to approach it as near as possible, thereby providing a safe passage into the elevator from the end of the rescue ladder, for example, from a rescue cage mounted thereon.

This object is achieved by a rescue elevator system comprising the features of claim 1.

At the elevator of the rescue elevator system according to the present invention, the suspension point for attaching the end of the rope is displaced towards the trailing end of the elevator, such that in the top end position of the elevator, the suspension point is still located in a distance from the deflection roller, considered in the extension direction of the rails. As a consequence, the elevator can be pulled towards the end of the rescue ladder further than with a suspension point commonly located near the leading end of the elevator, because unfavourable loads acting in a perpendicular direction to the rails and the framework of the ladder, also having the tendency to raise the elevator, are much lower with a considerable remaining distance between deflection roller and suspension point. Until the elevator reaches its end position, these force components are still considerably small, while the force components acting to pull the elevator into its end position along the rails are still sufficient.

The direct total distance between the deflection roller and the suspension at the elevator is bridged by an additional passage ladder that lies on top of the rope. This passage ladder is mounted between the rails at a hinge axis perpendicular to the extension direction of the rails, and the passage extends generally towards the end of the rescue ladder. By this hinge suspension, the passage ladder is pivotable between a flat position in which it lies generally parallel to the plane in which the rails are disposed, and an inclined position, in which it is inclined downwardly towards the bottom side of the rescue ladder. Because of this pivotable arrangement, the passage ladder can follow the changing angle of the rope section extending between the deflection roller and the suspension point, such that the passage ladder can contact the rope until the elevator reaches its end position.

At a low position of the elevator, this rope section extending between the suspension point and the deflection roller includes only a very small angle with the rope section running between the rope winch and the deflection roller, such that the rope sections running to and from the deflection roller are almost parallel. When the suspension point at the elevator approaches the end position at the free end of the rescue ladder, this angle increases, and the passage ladder is moved from its flat position towards an inclined position. In the end position of the elevator, the passage ladder bridges the distance between the suspension point and the deflection roller completely.

With the rescue elevator system according to the present invention, it is possible to move the elevator closer to the free end of the rescue ladder to make it easier for persons to enter the elevator, for example, from a rescue cage mounted at the end of the rescue ladder. This is further facilitated by the passage ladder. After entering the elevator, the elevator can be moved back to transport persons accommodated therein towards the ground.

According to a preferred embodiment of present invention, the passage ladder comprises an opening at its end through which the rope is guided to run freely to the opening. The opening is a guidance means to provide that the angle position of the passage ladder follows the actual position of the rope.

More preferably, the rescue elevator system according to the present invention comprises a spring to bias the passage ladder towards its flat position away from the inclined position.

According to another preferred embodiment of the present invention, the rails extend beyond the position of the deflection roller. Support rollers arranged at the leading front end of the elevator can run on these rails to pass the position of the deflection roller.

Preferably, in the end position of the elevator, the rope sections running from and to the deflecting roller include an angle smaller than 45°.

BRIEF DESCRIPTION OF THE DRAWINGS

These and other aspects of the present invention will be apparent from and elucidated with reference to an embodiment of the present invention described in the following figures.

DETAILED DESCRIPTION

Figure 1:
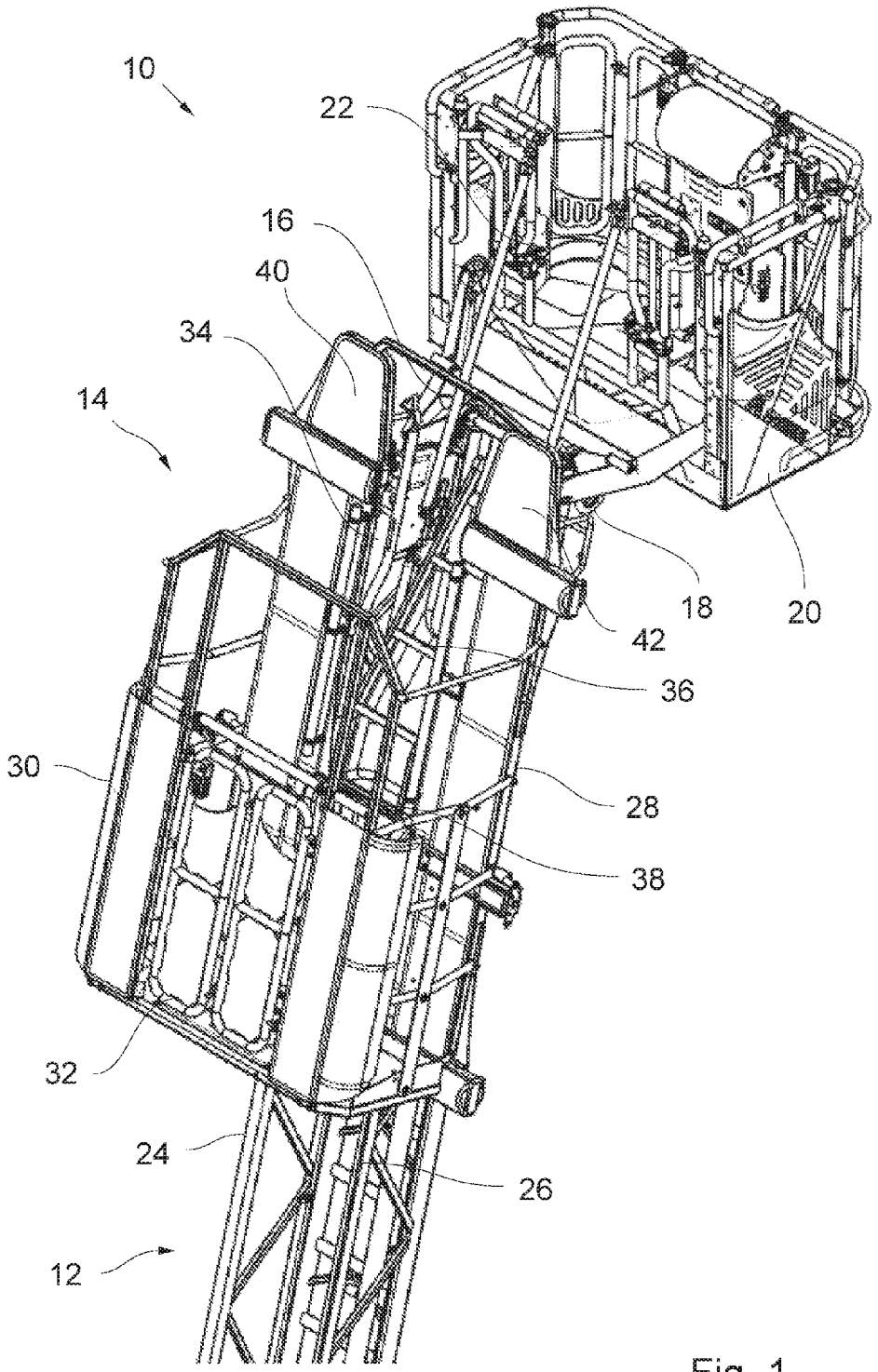
FIG. 1 is a perspective view of a top portion of a rescue elevator system according to one embodiment of the present invention.

FIG. 1 shows a rescue elevator system 10 of a firefighting vehicle, comprising a rescue ladder 12 and an elevator 14 that is movable along the rescue ladder 12 up to a movable free end portion 16 of the rescue ladder 12 carrying a rescue cage. The end of the elevator 14 facing this end 16 of the rescue ladder 12 will be designated as the leading end of the elevator 14, related to a course of the elevator 14 towards the free movable end 16 of the rescue ladder 12 carrying a rescue cage in the present example, and the opposite end of the elevator 14 during this course shall be referred to as its trailing end.

The free end 16 of the rescue ladder 12 comprises a mounting 18 to attach a rescue cage 20 at the rescue ladder 12. The rescue ladder 20 as such is known and shall not be further described in more detail in the following. It has a passage opening 22 at its rear portion such that a passenger can leave the rescue cage 20 through this passage opening 22 to enter the rescue ladder 12.

The elevator 14 runs on two parallel rails 24, 26 mounted on the top side of the rescue ladder 12 and extending longitudinally over its extension length. The elevator 14 comprises a chassis 28 with rollers to run on the rails, and an elevator cage 30 mounted on the chassis 28 for accommodating passengers. The elevator cage 30 comprises in a known fashion a framework to protect passengers or items located therein and to secure them from falling out of the elevator cage 30. A door 32 at the top side of the elevator cage 30 opposite to the rails 24, 26 is provided for entering or leaving the cage 30.

At the bottom side of the elevator 14, a recess 34 is provided that extends between the rails 24, 26. In this recess 34, a passage ladder 36 is mounted with its lower end 38 at a hinge axis, such that the upper end of the passage ladder 36 can be pivoted around the hinge axis. The hinge axis stands perpendicular to the extension direction of the rails 24, 26, i.e. in a traverse direction to the extension of the rescue ladder 12. In the position shown in FIG. 1, the passage ladder 36 is slightly inclined with respect to the extension direction of the rescue ladder 12 such that it extends from the hinge axis 47, lying within a plane on top of the rescue ladder 12, towards the mounting 18 of the rescue cage 20, which is displaced towards the bottom of the rescue ladder 12. This will be further described in the following in connection with the operation of the passage ladder 36 and its interaction with the elevator drive.

The hinge axis of the passage ladder 36 is mounted at the chassis 28 of the elevator 14, and the recess 34 is formed within the chassis 28 as well as in the bottom of the body of the elevator cage 30. Two lateral plates 40, 42 extend to both sides of the recess 34 to cover the chassis 28 and the rails 24, 26.

The elevator 14 is driven by an elevator drive that comprises a rope, a rope winch for pulling the rope and a deflection roller over which the rope is guided from the rope winch to a suspension point at the elevator. This will be explained in more detail in the following FIGS. 2 and 3.

Figure 2:
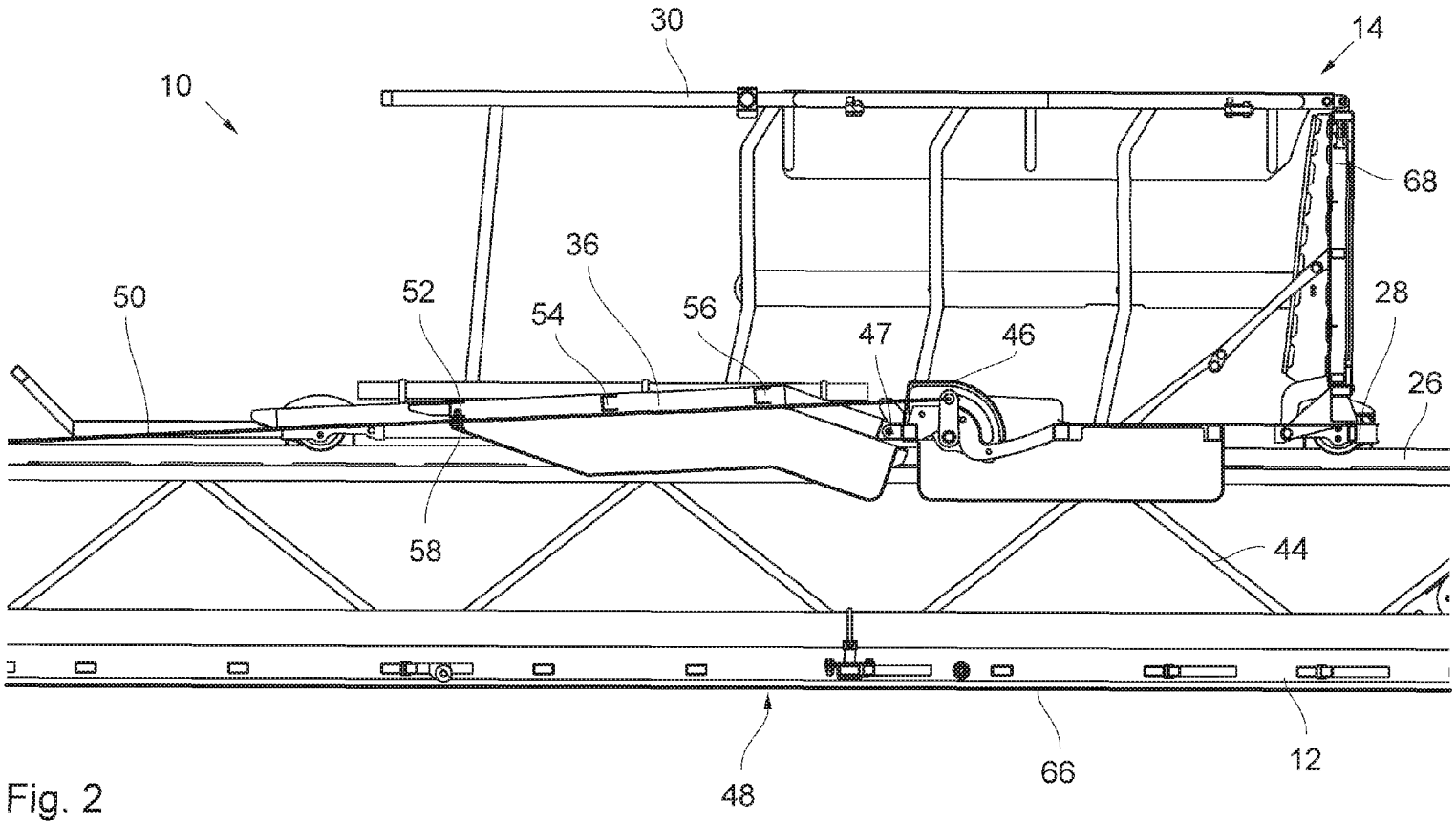
FIGS. 2 and 3 are schematic side views in section of the rescue elevator system of FIG. 1 in two different states of operation.
Figure 3:
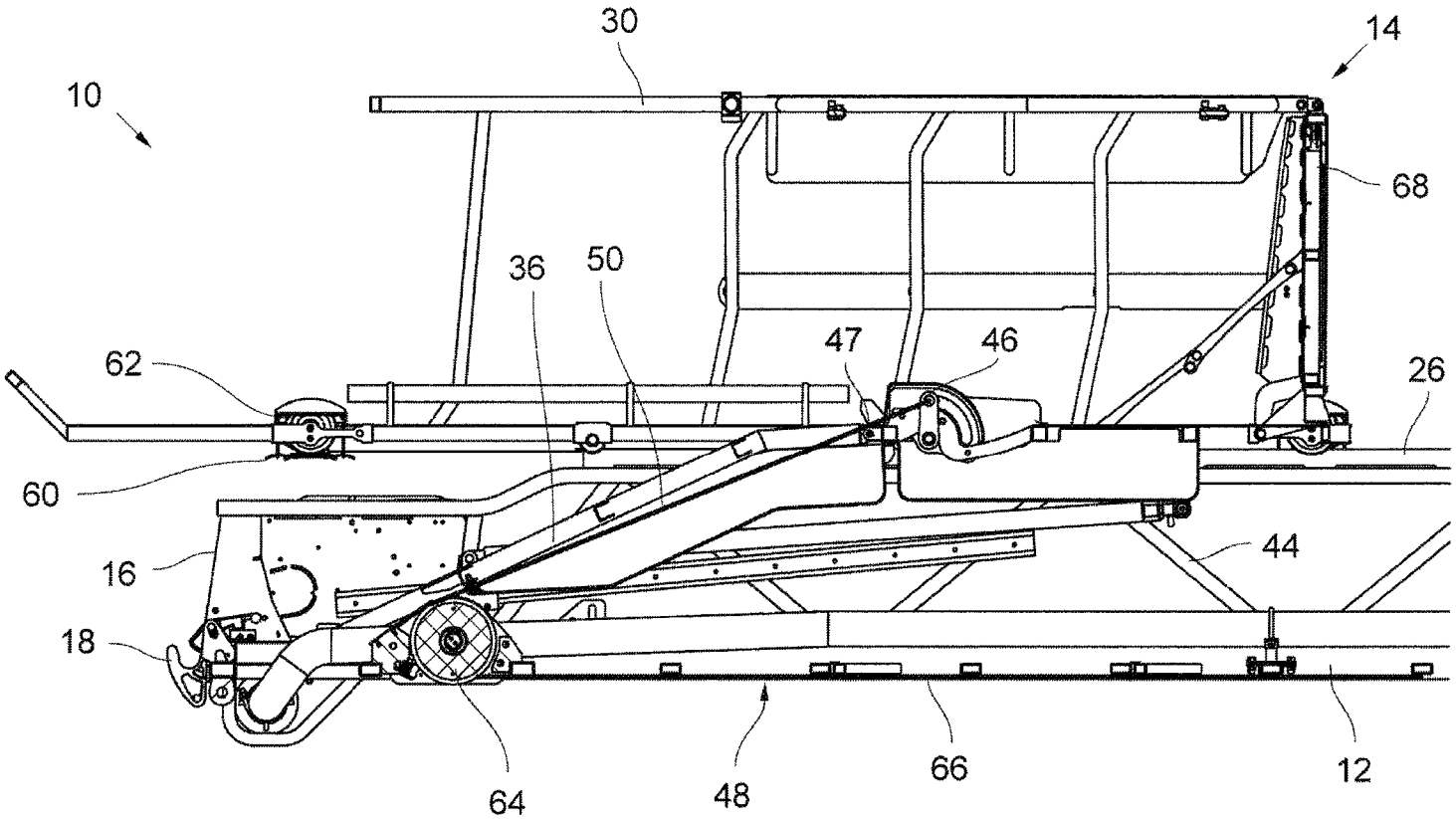

FIG. 2 shows the elevator 14 in a position with a distance from its end position at the end 16 of the rescue ladder 12, which is shown in FIG. 3. The section view in FIG. 2 shows the framework 44 of the rescue ladder 12, with one of the rails 26 on its top. In FIG. 2, this rail 26 extends in the horizontal direction. By moving the elevator 14 to the left side in FIG. 2, it approaches its end position, since the free end of the rescue ladder 12 is located there (not shown in FIG. 2).

The suspension point 46 for the rope 48 is located within the chassis 28 of the elevator 14 behind the hinge axis 47 of the passage ladder 36, related to the movement of the elevator 14 towards its end position (to the left in FIG. 2). From the suspension point 46, the rope 48 runs towards to the top end 16 of the rescue ladder 12, where a deflection roller is located. Because this deflection roller is positioned within the framework 44 at the bottom side of the rescue ladder 12 averted from the rails 24, 26 (refer to FIG. 3 and the description below), the rope 48 has a slight inclination at its section connected with the suspension point 46.

While the hinge axis 47 of the passage ladder 36 is located below this rope section 50, a main portion of the passage ladder 36, comprising three rungs 52, 54, 56, lies on top of this rope section 50, as this rope section 50 is guided from the suspension point 46 through the space between the hinge axis 47 and the rungs 52, 54, 56. At the bottom side of the top rung 52, an opening 58 is provided through which the rope 48 is guided to run freely through the opening 58. This opening 58 is a guiding means that provides a coupling of the movement of the section 50 of the rope 48 shown in FIG. 2 and the passage ladder 36. If the inclination angle of the rope section 50 connected with the suspension point 46 changes with the course of the elevator 14, the passage ladder 36 changes its inclination with respect to its hinge axis 47.

A deflection roller 64 is disposed below the rails 24, 26 near the end 16 of the rescue ladder 12, with its turning axis extending horizontally and perpendicular to the extension direction of the rails 24, 26. It is provided for deflecting the rope 48 on its path between the rope winch and the suspension point 46, in a way that the rope 48 runs from the rope winch in the bottom portion of the rescue ladder 12 along the extension direction to the deflection roller 64, is deflected by the deflection roller 64 and runs from the deflection roller 64 back to the suspension point 64 at the elevator 14 on top of the rescue ladder 12. The rope section 66 running from the rope winch towards the deflection roller 64 and the rope section 50 between the deflection roller 64 and the suspension point 46 include an angle of approximately 30° in the end position of the elevator 14 shown in FIG. 3.

In this top end position, the leading support rollers 60 of the chassis 28 of the elevator 14, running on the rails 24, 26, run over the longitudinal position of the deflection roller 64.

When the elevator 14 runs from a lower position shown in FIG. 2 towards to the free end 16 of the rescue ladder 12, to reach its top end position, the angle between the rope sections 50 and 66 running to and from the deflection roller 64 increases to maximum value demonstrated in FIG. 3. It is noted that in the present embodiment, this maximum angle is still well below 45°. Keeping this angle small results in a preferable transmission of the pulling force that is exerted by the rope winch along the rope 48 into the suspension point 46. Namely, if the incoming and outgoing rope sections 50 and 66 run almost parallel, they are transmitted as an upward pulling force onto the elevator 14 to pull it along the rails 26, 28 towards the end 16 of the rescue ladder 12. However, with increasing angle between the incoming and outgoing rope sections 50, 66, there is also an increasing force component perpendicular to the rails 24, 26, acting to pull the elevator 14 against the rescue ladder 12 and increasing the load on the framework 44.

To keep the angle between the rope sections 50 and 66 small, the suspension point 46 is displaced towards the trailing end 68 of the elevator 64, averted from the free end 16 of the rescue ladder 12 where the rescue cage is located, such that with respect to the extension direction of the rails 24, 26, the suspension point 46 is located in a distance from the deflection roller 64. If this distance increases, the angle between the incoming and outgoing rope sections 50, 66 becomes smaller. This is a great advantage over elevators with suspension points for the rope at their leading end portion, resulting in an end position in which the rope section 50 between the deflection roller 64 and the suspension point 64 stands almost perpendicular to the rails 24, 26, with an unfavourable load transmission, as described above.

The arrangement shown in FIG. 3 also allows to pull the elevator 14 closer towards the free end 16 of the rescue ladder 12, because there is still a sufficient distance in the running direction of the elevator 14 between the deflection roller 64 and the suspension point 46, i.e. their distance along the rescue ladder 12 (horizontal distance in FIG. 3) is still great enough. However, pulling the elevator cage 30 closer towards the mounting 18 for the rescue cage 20 shortens the distance between the passage opening 22 of the rescue cage 20 (FIG. 1) and the elevator cage 30. Moreover, the passage ladder 36 bridges this distance, or at least the distance between the suspension point 46 and the deflection roller 64. Because of its pivotable movement around the hinge axis 47, it can follow the changing inclination of the rope section 50 between the deflection roller 64 and the suspension point 46 such that it can move from the generally flat position shown in FIG. 2 into the inclined position shown in FIG. 3, in which the passage ladder 36 is inclined from its hinge axis 47 downwardly towards the bottom side of the rescue ladder 12 (i.e. the side averted from the top side were the rails 24, 26 are located). That is, the passage ladder 36 extends generally towards the free end 16 of the rescue ladder 12 but changes its inclination relative to the extension direction of the rescue ladder 12 while being guided by the rope section 50.

The movement from the flat position into the inclined position shown in FIG. 3 can be supported by a spring (not shown) to bias the passage ladder 36 against the cross forces of the rope away from the inclined position towards the flat position. This spring can be realized in many different ways, for example, as a pneumatic spring.

From the end position shown in FIG. 3, the elevator 14 can be lowered into the opposite direction towards the mounting end of the rescue ladder 12 (located on the right side in FIGS. 2 and 3, thereby decreasing the angle between the incoming and outgoing rope sections 50 and 66 again and moving the passage ladder 36 back into to the generally flat position in FIG. 2.

What is claimed is:

1. A rescue elevator system, comprising a rescue ladder having rails on a top side thereof and an elevator comprising a chassis and an elevator cage, configured to accommodate passengers, fixedly mounted on the chassis, the chassis configured to run on the rails up to an end position at a first end of the rescue ladder, the rescue elevator system further comprising an elevator drive comprising a rope and a roller over which the rope is guided to a suspension point of the elevator, wherein the roller is disposed below the rails at or near said first end of the rescue ladder, wherein the suspension point is arranged far enough from a leading end of the elevator that, when the chassis is at the end position, sections of the rope running to and from the roller form an angle smaller than 45°, the leading end being an end of the elevator facing the first end of the rescue ladder, the rescue elevator system further comprising a passage ladder mounted between the rails at a hinge axis perpendicular to an extension direction of the rails, the passage ladder extending towards said first end of the rescue ladder and being pivotable between a flat position in which the passage ladder lies on top of the rope while being substantially parallel to a plane of the rails and an inclined position in which the passage ladder lies on top of the rope while being inclined downwardly towards a bottom side of the rescue ladder opposite to said top side of the rescue ladder, wherein said hinge axis is mounted on the chassis of the elevator.

2. The rescue elevator system according to claim 1, characterized in that the passage ladder comprises an opening through which the rope is guided to run freely.

3. The rescue elevator system according to claim 1, characterized in that the passage ladder comprises three rungs.

4. The rescue elevator system according to claim 1, characterized in that the rails extend beyond a position of the roller.

5. The rescue elevator system according to claim 1, further comprising a rescue cage attachable to a mounting of the rescue ladder such that, when the chassis is at the end position, said passage ladder extends from the hinge axis towards the mounting at an incline with respect to the extension direction of the rails.

* * * * *